United States Patent [19]

Sterken

[11] Patent Number: 4,778,405

[45] Date of Patent: Oct. 18, 1988

[54] T-TAP ELECTRICAL CONNECTOR HAVING OPENING FOR TEST PROBE

[75] Inventor: Cornelus A. H. M. Sterken, Eindhoven, Netherlands

[73] Assignee: AMP Incorporated, Harrisburg, Pa.

[21] Appl. No.: 658,093

[22] Filed: Oct. 5, 1984

[51] Int. Cl.[4] ..... H01R 4/24

[52] U.S. Cl. ..... 439/395

[58] Field of Search ..... 339/97 R, 97 P, 98, 339/99 R

[56] References Cited

U.S. PATENT DOCUMENTS

| | | | |
|---|---|---|---|
| 1,290,153 | 1/1919 | Fitzpatrick | 339/98 |
| 1,488,636 | 4/1924 | Geiser | 339/98 |
| 3,982,319 | 9/1976 | Bice | 339/97 R |
| 4,127,312 | 11/1978 | Fleischhacker | 339/99 R |
| 4,153,326 | 5/1979 | Frantz et al. | 339/99 R |
| 4,262,984 | 4/1981 | Takahashi | 339/97 R |
| 4,451,867 | 5/1984 | Robertson | 339/98 |

*Primary Examiner*—Joseph H. McGlynn

*Attorney, Agent, or Firm*—Frederick W. Raring; Robert W. J. Usher

[57] ABSTRACT

Electrical connector for connecting a pair of side-by-side tap wires to through wires comprises a generally T-shaped housing having side-by-side parallel channels extending through the head for the through wires and having parallel side-by-side channels extending into the free end of the stem for the tap wires. The terminals are substantially L-shaped and offset slightly from each other. The terminals intersect the channels in the head and have wire receiving slots for the through wires. The terminals have ends adjacent to the free end of the stem which are directly inwardly towards each other and which intersect the channels for the tap wires. An opening is provided in the housing between the two terminals in the stem for a test probe to permit carrying out of a continuity test. The housing has a pair of covers, one for the head of the housing and one for the stem, which can be separately assembled so that the electrical connections to the through wires and the tap wires need not be made at the same time. Additionally, the housing is constructed such that it can be filled with a waterproof grease to moisture-proof the finished tap connection.

7 Claims, 5 Drawing Sheets

T-TAP ELECTRICAL CONNECTOR HAVING OPENING FOR TEST PROBE

This invention relates to electrical connectors making T-taps between a pair of through wires and a pair of tap wires. The invention is particularly concerned with a connector which has an opening to permit continuity testing after the connections have been made, which permits the through wires and the tap wires to be connected to the terminals in the connector at different times or on different occasions, and to the provision of a connector which can be moisture-proof if desired.

BACKGROUND OF THE INVENTION

A need presently exists for a T-tap type connector which can be waterproof if desired, which has an opening between the terminals of the connector so that a continuity test can be carried out after the connector has been installed on the through wires and the tap wires, and which additionally is such that the tap wires or the through wires can be connected to the terminals prior to connecting the remaining pair of wires to the terminal. For example, there are occasions when it is desirable to connect tap wires, which may extend to an instrument or to an electrical device, on one occasion and at a later time connect the tap wires to the through wires. While there are a wide variety of tap-type connectors available, there are none which would satisfy the requirements as discussed above. The present invention is directed to the achievement of such a connector.

BRIEF DESCRIPTION OF THE INVENTION

The invention comprises an electrical connector assembly for connecting first and second tap wires to first and second through wires respectively. The assembly comprises a housing body having first and second terminals therein, each of the terminals having a tap wire slot and a through wire slot for receiving, and establishing eletrical contact with, one of the tap wires and one of the through wires. The connector assembly is characterized in that the housing is generally T-shaped having a head and a stem which extends normally from the head. The head has parallel side-by-side first and second through wire channels extending therethrough normally of the stem for receiving the first and second through wires. The stem has a free end which is spaced from the head and a fixed end which is integral with the head. Parallel side-by-side first and second tap wire channels extend inwardly from the free end towards the fixed end for reception of the tap wires. The first and second contact terminals extend in parallel spaced-apart relationship from a location adjacent to the free end of the stem along the stem and into the head. The first and second tap wire channels are between the first and second terminals in the stem and the first terminal has a first tap wire contacting portion which extends laterally therefrom and which intersects the first tap wire channel. A first through wire contacting portion extends from the first terminal into the head and intersects the first through wire channel. Similarly, the second terminal has a second tap wire contacting portion which extends laterally in the stem and intersects the second tap wire channel. The second terminal has a through wire portion which intersects the second through wire channel. The wire receiving slots in the terminals are positioned in the several channels so that when the wires are inserted into the slots, they will be retained in the channels and electrical contact will be established with the wires.

In accordance with further embodiments, an opening extends through the stem at a location between the first and second terminals and between the fixed end and the free end of the stem. The first and second tap wire channels then extend from the free end to the opening. The first and second terminals are of stamped and formed conductive sheet metal, each of the terminals having oppositely facing major surfaces which are rolled surfaces and sheared side edges. The major surfaces of the first and second terminals are in parallel spaced-apart planes on each side of the tap wire channels and the wire slots extend inwardly from the sheared edges. The terminals may be mirror images of each other and axially offset from each other by a distance which is equal to the spacing between the first and second through wires.

In accordance with further embodiments, cover means are provided for the housing which cover means are provided with wire inserters that push the wires into wire receiving slots of the terminals when the cover means are assembled to the housing. In one embodiment, two separate covers are provided, one for the head portion of the housing and one for the stem portion of the housing. The housing and the covers may be produced as a single molding with the two covers connected to the housing by flexible straps which are flexed when the covers are assembled to the housing.

THE DRAWING FIGURES

THE DISCLOSED EMBODIMENT

Figure 1:
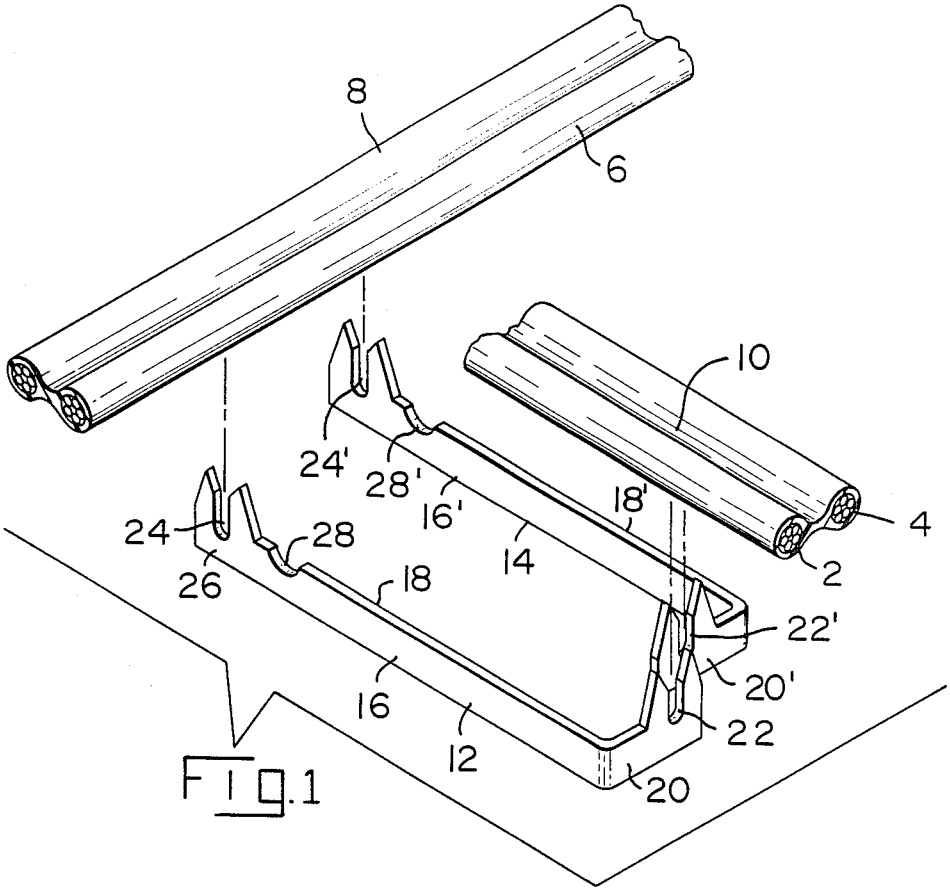
FIG. 1 is a perspective view of the terminals used in the connector positioned in their proper relative positions with respect to each other and with the through wires and the tap wires in alignment with the wire receiving slots of the terminals.
Figure 2:
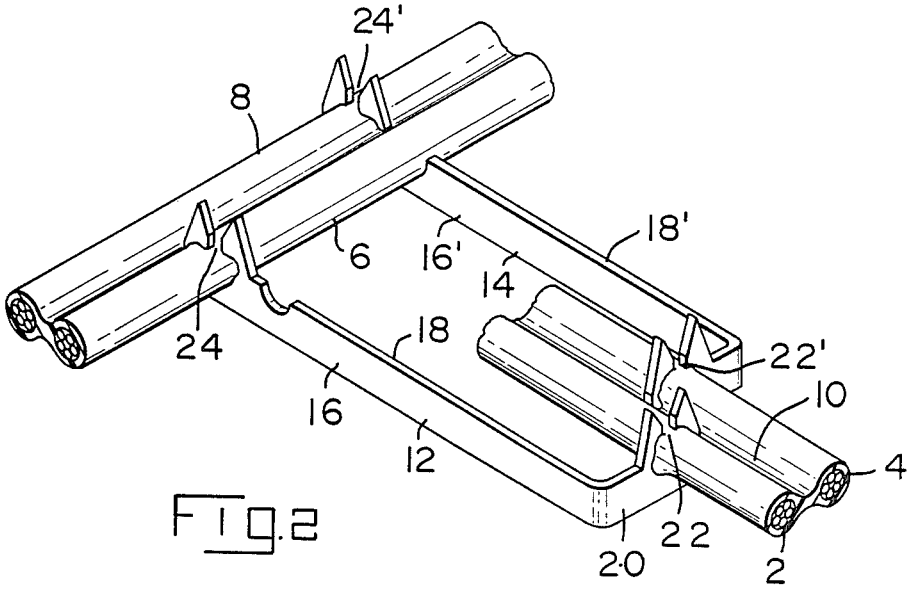
FIG. 2 is a view similar to FIG. 1 but showing the wires in their inserted positions and connected to the terminals.
Figure 3:
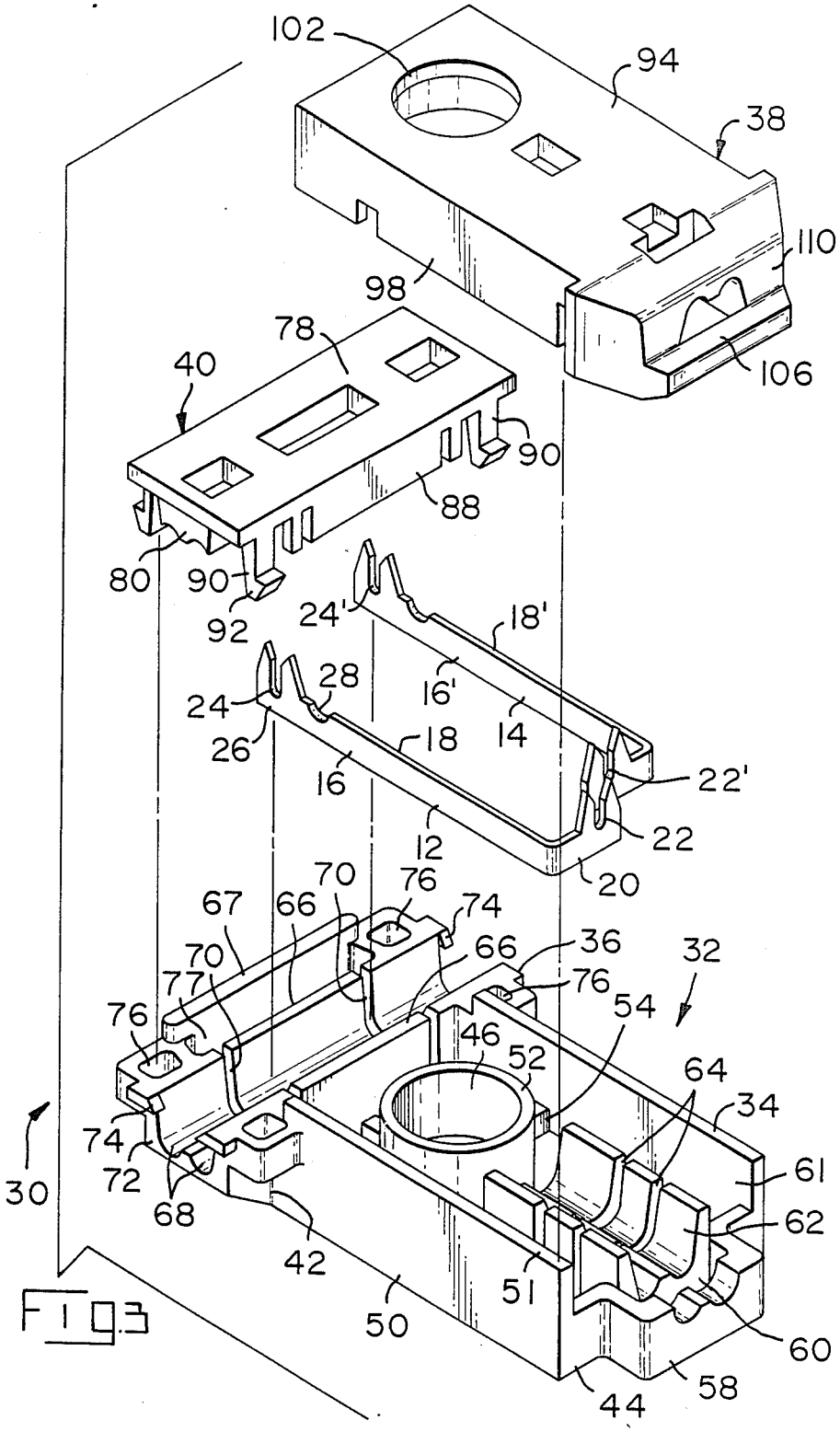
FIG. 3 is a perspective view of the connector assembly with the parts exploded from each other.

As shown in FIGS. 1 and 2, the connector of the present invention serves to connect first and second tap wires 2, 4 to first and second through wires 6, 8. The tap and through wires are contained in a single insulating extrusion, the two insulated wires being connected to each other by an integral web 10. The electrical connections of the tap wires to the through wires are made by first and second terminals 12, 14 which are mirror images of each other so that a description of the terminal 12 will suffice for both. The same reference numerals, differentiated by prime marks, are used to describe the two terminals.

The first terminal 12 has an elongated shank portion 16 which has oppositely facing major surfaces that were the rolled surfaces of the stock from which the terminal was produced. The edges 18 are sheared edges. A flange 20 extends laterally rightwardly, as viewed in FIG. 1, from the lower end of the first terminal and a first tap wire receiving slot 22 extends downwardly from a projection on the upper sheared edge of this flange. A first through wire slot 24 is provided in the terminal adjacent to the free end 26 thereof and a notch 28 is provided in the upper edge having a generally arcuate edge. The center of the notch 28 is spaced from the center of the slot 24 by a distance substantially equal to the distance between the centers or axes of the first and second through wires 6, 8. Since the first and second terminals 12, 14 are mirror images of each other, they can be formed from identical flat blanks, the only difference between the terminals being that the flange 20' of the terminal 14 is bent in the opposite direction from that of the flange 20 of the terminal 12.

As shown in FIGS. 3 to 9, the connector assembly 30 comprises a main body portion 32 and covers 38, 40. The body portion 32 has a stem portion 34 and a transversely extending head 36. The stem 34 has a fixed end 42 which is integral with the head 36 and a free end 44 which is spaced from the head. The interior of the main body portion 32 is hollow but contains wire supporting channel surfaces and a circular wall as described below.

The opening 46 extends through the major external wall 48 of the body and is defined by an internal circular wall 52 which extends from the internal floor or major surface of the body. The main body has parallel sidewalls 50 having upper edges 51 which are located above the upper end of the circular wall 52. Ribs 54 extend from the sidewalls 50 to the circular wall 52 for supporting purposes and additional ribs 56 are provided so that this wall is supported entirely around its periphery. The free end of the stem has a reduced width extension 58 in which there is provided a generally rectangular opening 59 which receives a portion of the stem cover as will be described below.

Figure 4:
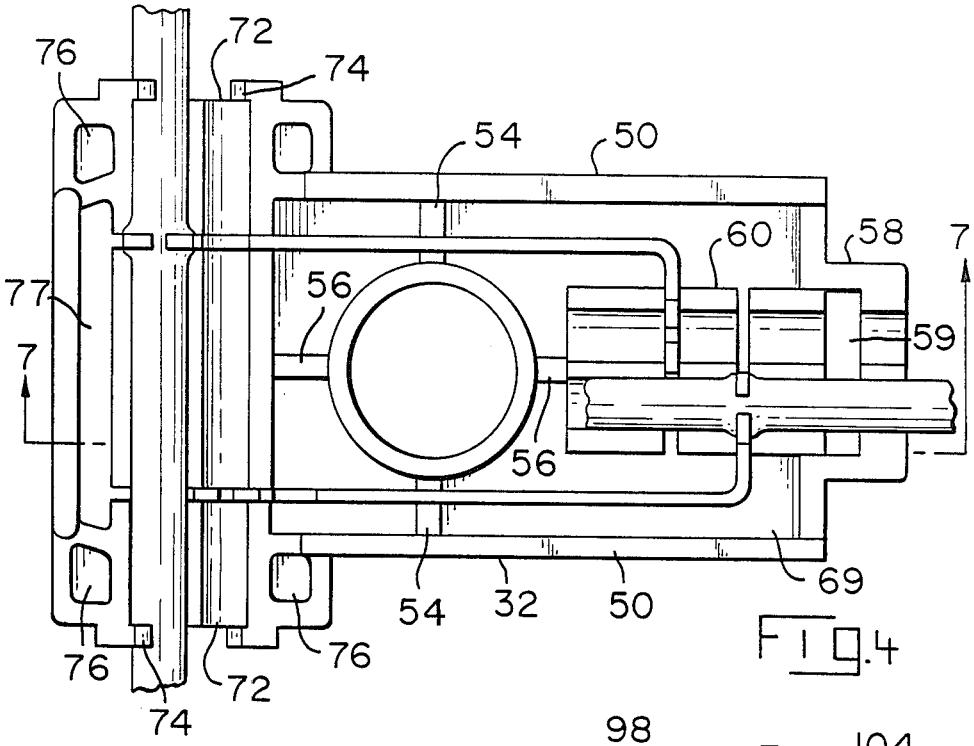
FIG. 4 is a plan view of the housing body showing the interior of the housing body.
Figure 5:
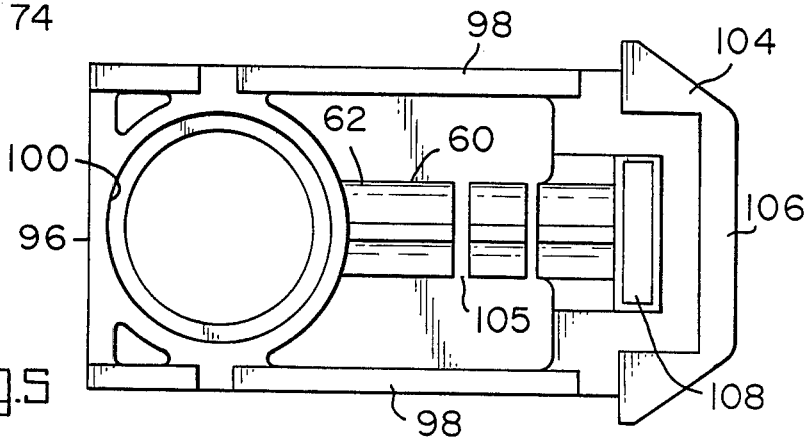
FIG. 5 is a plan view showing the interior of the stem cover.
Figure 6:
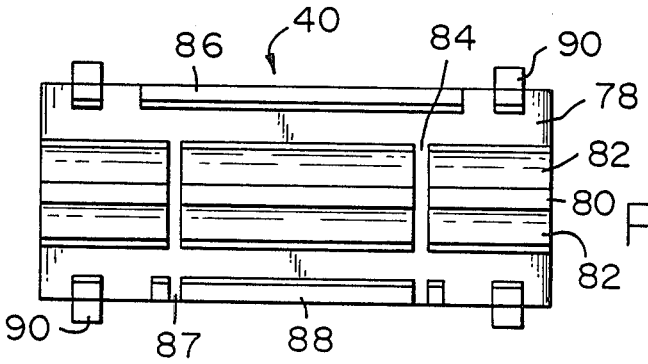
FIG. 6 is a plan view of the interior of the head cover.
Figure 7:
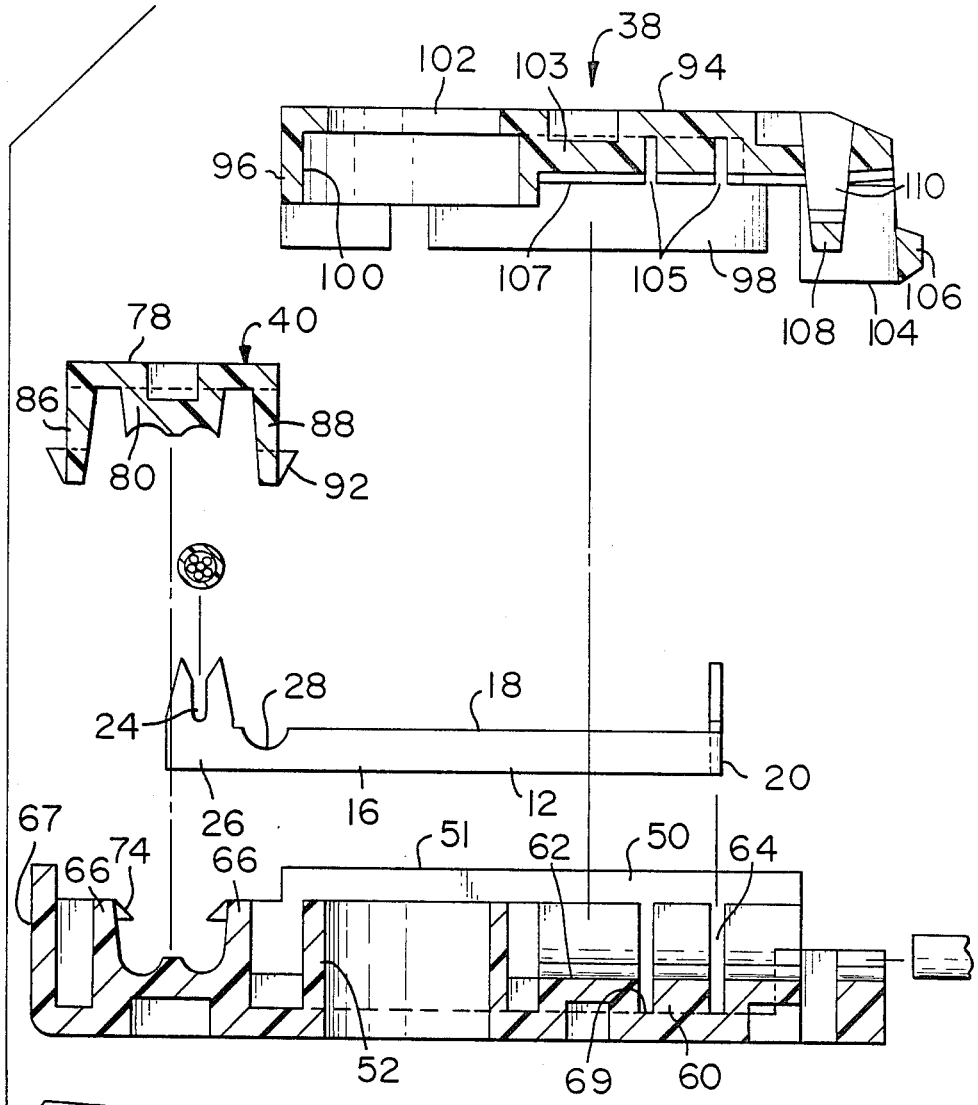
FIG. 7 is a view looking in the direction of the arrows 7—7 of FIG. 4 but with the covers in alignment with the housing body.

A relatively wide rib 60 extends outwardly from the floor 69 of the interior of the stem from the reduced width extension 58 to a location adjacent to the internal circular wall 52. The upper surface of the this rib has spaced-apart channels 62 which receive the spaced-apart tap wires when the connector is installed on the wires. Transverse slots 64 extend through this rib for reception of the flange portions 20, 20' of the terminals as shown in FIG. 4.

The head 36 of the main body portion 32 has an outer transverse wall 67 and spaced-apart internal walls 66 which define an elongated pocket or nest for the through wires. The inner surface of this pocket has spaced-apart arcuate channels 68 in which the through wires are positioned and located when the terminals are connected to the wires. Slots as shown at 70 extend transversely through these internal walls for reception of the free end portions of the terminals so that the through wire receiving slots of the terminals will be substantially centrally located in the channels 68. Advantageously, wire retaining ears 74 are provided on the end surfaces or endwalls 72 of the head. These ears 74 extend inwardly over the channels adjacent to the endwalls and serve to retain the through wires in the channel while the connector is being installed on the through wires. Openings 76 extend through the head portion adjacent to the four corners thereof and receive latch arms on the head cover as will be described below. A central blind opening 77 is provided adjacent to the outer walls 67 and between the openings 76 for reception of a flange 86 of the head cover.

The head cover 40 is a flat generally rectangular plate-like member 78 having a centrally located transversely extending rib 80, the surface of which is also provided with arcuate side-by-side channels for the wires. Transverse slots 84 extend through this rib for reception of the outer edge portions of the terminals when the cover is assembled to the main body. The rib 80 functions as an inserter in that when the cover is assembled to the body, the surface of the rib will engage the wires and push them into the slots. Flanges 86, 88 extend from the side edges of the plate-like section 78, the flange 88 being provided with slots 87 as shown which are in alignment with the slots 84 for the accommodation of the terminals. The flange 86 extends into the blind opening 77 and the flange 88 lodges beside the internal wall 66 of the main body portion when the head is assembled to the main body. The head cover is maintained in assembled relationship by latch arms 90 which extend through the openings 76 and which have enlarged outer ends 92 that provide shoulders that bear against the underside of the openings.

The stem cover 38 comprises a generally rectangular panel 94 having an integral endwall flange 96 extending therefrom and sidewall flanges 98. An opening 102 extends from the exterior of the panel member 94 and internally a circular recess 100 is provided in alignment with the opening for reception of the circular or cylinder wall 52 of the main body portion. It will be apparent from the drawings that the radius of the recess 100 is such that it will receive the circular wall 52, advantageously with a tight friction fit. Normally, a slight draft or slope will be provided on the wall 100 and a matching draft on the exterior of the cylindrical wall 52 of the main body.

Figure 8:
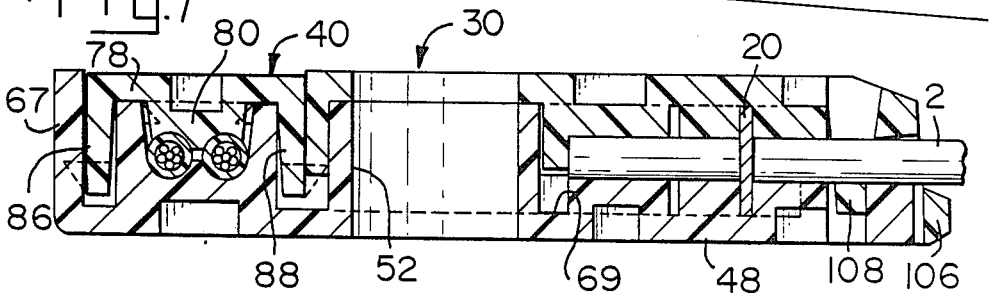
FIG. 8 is a perspective view of the connector assembly with the parts assembled to each other.

A central rib 103 extends axially towards the recess and has transversely extending slots 105 for the upper edges of the terminals when the cover is assembled to the stem. The surface of this rib is provided with side-by-side depressions or channels 107 which are spaced apart by a distance equal to the spacing between the two tap wires so that the wires will be captured by the surfaces 108 and the corresponding surfaces in the stem of the main body portion. Arms 104 extend from the panel-like member adjacent to the free end of the cover, the end which corresponds to the free end of the stem portion of the main body, and these arms 104 are connected by a transverse integral strap 106. The arms 104 and the integral strap 106 extend around the reduced width extension 58 of the main body portion when the parts are assembled as shown in FIG. 8.

It is desirable to provide a means to hold the tap wires on the stem cover during assembly of the stem cover to the stem of the main body. In order to provide for such retention, a pair of support arms 110 extend inwardly from the panel section between the arms 104 and are connected by an integral transverse section or strap 108. The internal surface of the connecting strap 108 is again contoured with side-by-side arcuate surfaces which locate the tap wires when the wires are positioned therein. In order to assemble the tap wires temporarily to the cover, then, it is merely required that the ends of the tap wires be inserted between the strap section 108 and the supporting surfaces of the rib 103. The wall which defines the recess 100 will function as a stop for the wires so that the technician will be informed as to when the wire has been inserted to the proper length.

When the stem cover is assembled to the stem, the arms 104 and the connecting section 106 surround the reduced width extension 58 as previously described and the support 108 for the wires will extend through the rectangular opening 59 in the extension 58 of the main body portion.

Figure 9:
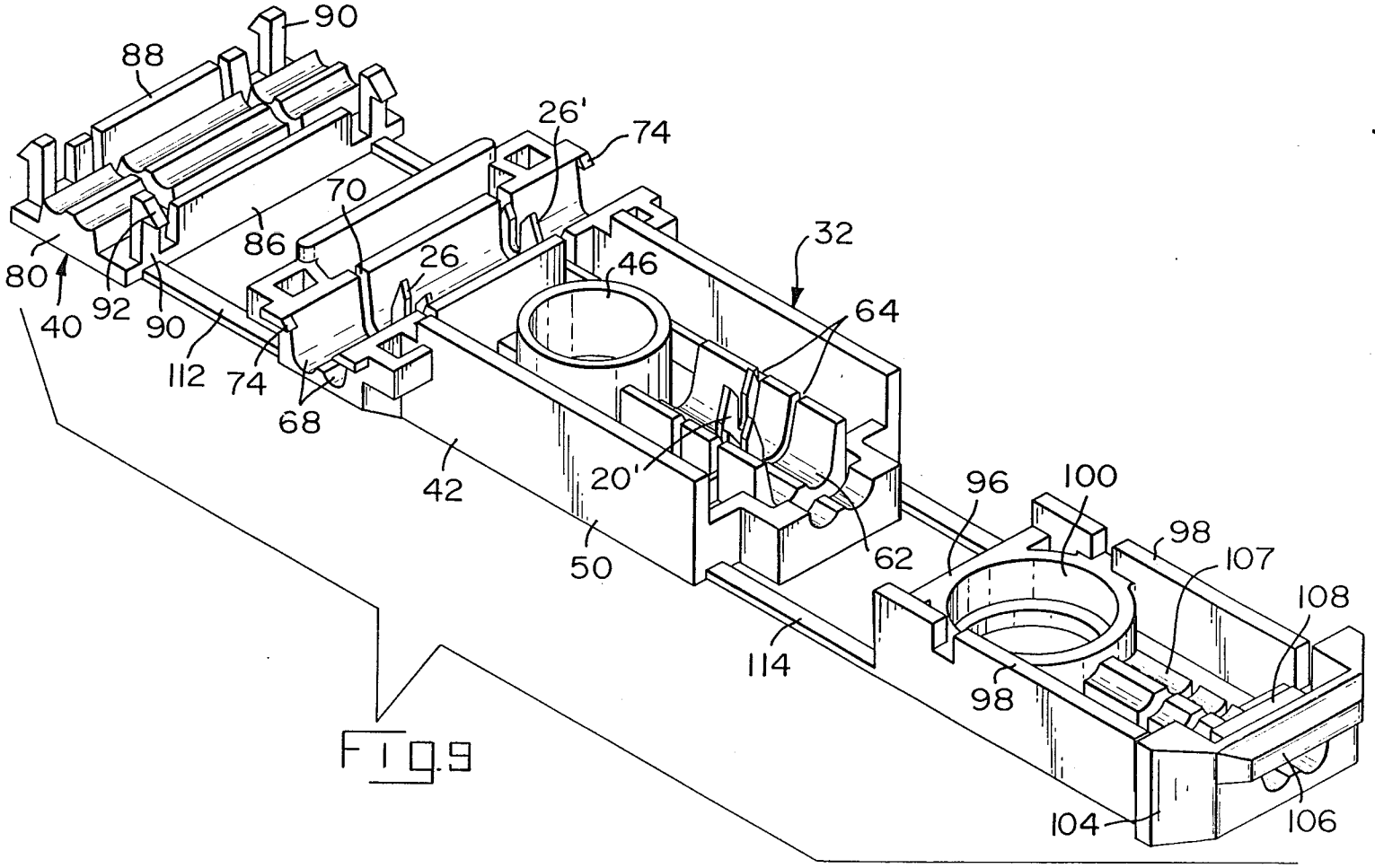
FIG. 9 is a perspective view showing the manner in which the housing body and the housing covers can be produced as a single molding in strip form.

FIG. 9 shows the manner in which the complete assembly can be produced as a single molding with the main body section of the housing connected by hinges 112, 114 to the head cover and the stem cover respectively. If the connector housing is produced as a single molding in this manner, correct assembly of the covers to the main body portion is encouraged in that the technician is guided by the hinges as to how the covers should be aligned with the main body prior to their being coupled to the main body. Additionally, it is desirable to produce a plurality of assemblies in the form of continuous strip, as also shown in FIG. 9, with each connector assembly connected to the next adjacent connector assembly by removable connecting sections 116. The housings can thus be produced by continuous or semicontinuous molding processes with the housings spaced apart by a predetermined distance. The terminals can then be assembled to the housing by automatic machinery which would separate individual terminals from a continuous strip, bend the flanges of the terminals in the proper directions, and then automatically insert the terminals into the main body portion of the housing.

After the wires have been connected to the terminals in the connector and the covers assembled to the connector body, a continuity test can be made by virtue of the fact that the opening extends through the stem portion of the body between the two terminals. A probe of a magnetic field detecting instrument can be positioned in this opening and a reading taken to determine if there is a current flowing through the tap wires which would thereby indicate that the proper connections have been made.

The connector assembly can be rendered moisture-resistant or waterproof by packing a suitable waterproof grease into the interior of the body so that the entrances to the connector are blocked with the grease as it is extruded when the covers are assembled to the main body. As shown in FIG. 8, the head cover and the stem cover are nested in the projecting sidewall and endwall portions of the main body and the covers themselves have flanges and sidewalls which are capable of forming relatively tight seals to prevent the entrance of moisture into the interior of the connector.

I claim:

1. An electrical connector assembly for connecting first and second tap wires to first and second through wires respectively, the connector assembly comprising a housing body having first and second terminals therein, each of the terminals having a tap wire slot and a through wire slot for receiving, and establishing electrical contact with, one of the tap wires and one of the through wires, the connector assembly being characterized in that:

the housing is generally T-shaped having a head and a stem which extends normally from the head, the head having parallel side-by-side first and second through wire channels extending therethrough normally of the stem for receiving the first and second through wires.

the stem having a free end which is spaced from the head and having a fixed end which is integral with the head, parallel side-by-side first and second tap wire channels extending inwardly from the free end towards the fixed end for reception of the first and second tap wires, the first and second contact terminals extending in parallel spaced-apart relationship from a location adjacent to the free end of the stem along the stem and into the head, the first and second tap wire channels being between the first and second terminals, the first terminal having a first tap wire contacting portion which extends laterally therefrom and which intersects the first tap wire channel and having a first through wire contacting portion which intersects the first through wire channel, the second terminal having a second tap wire contacting portion which extends laterally therefrom and which intersects the second tap wire channel and having a second through wire contacting portion which intersects the second through wire channel, the first and second terminals being of stamped and formed sheet metal, each of the terminals having oppositely facing major surfaces and sheared side edges, the major surfaces of the first and second terminals being in parallel spaced-apart planes on each side of the tap wire receiving channels, the wire slots extending inwardly from one of the sheared edges, the terminals being axially offset from each other by a distane equal to the spacing between the first and second through wires.

2. An electrical connector assembly as set forth in claim 1 characterized in that an opening extends through the stem portion at a location between the first and second terminals and between the fixed end and the free end, the first and second tap wire channels extending from the free end to the opening.

3. An electrical connector assembly as set forth in claim 1 characterized in that the first and second terminals are mirror images of each other.

4. An electrical connector assembly as set forth in claim 1 characterized in that cover means are provided for the housing body, the cover means having integral tap wire inserters and through wire inserters for pushing the tap wires and the through wires into the tap wire slots and the through wire slots respectively when the cover means is assembled to the housing body.

5. An electrical connector assembly as set forth in claim 4 characterized in that the cover means comprises a separate head cover part and a separate stem cover part whereby the tap wires and the through wires can be connected to the terminals in separate operations.

6. An electrical connector assembly as set forth in claim 5 characterized in that at least one of the cover parts has an integral wire holder and positioner for holding the wires and precisely positioning the wires in alignment with the terminals during assembly of the at least one cover part to the housing body.

7. An electrical connector assembly as set forth in claim 6 characterized in that the stem cover part has an integral stem wire holder and positioner.

* * * * *